US009500150B2

(12) United States Patent
Kato et al.

(10) Patent No.: US 9,500,150 B2
(45) Date of Patent: Nov. 22, 2016

(54) POWER CONTROL DEVICE FOR CARGO HANDLING VEHICLE

(71) Applicant: KABUSHIKI KAISHA TOYOTA JIDOSHOKKI, Kariya-shi, Aichi (JP)

(72) Inventors: Norihiko Kato, Kariya (JP); Yukikazu Koide, Kariya (JP); Hiroyuki Tanaka, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 0 days.

(21) Appl. No.: 14/663,635

(22) Filed: Mar. 20, 2015

(65) Prior Publication Data

US 2015/0267632 A1 Sep. 24, 2015

(30) Foreign Application Priority Data

Mar. 24, 2014 (JP) ..... 2014-060085

(51) Int. Cl.

| | |
|---|---|
| ***F02D 41/08*** | (2006.01) |
| ***F02D 29/02*** | (2006.01) |
| ***F02D 29/04*** | (2006.01) |
| ***B66F 9/20*** | (2006.01) |
| ***B66F 9/22*** | (2006.01) |

(52) U.S. Cl.

CPC ..... *F02D 41/083* (2013.01); *B66F 9/20* (2013.01); *B66F 9/22* (2013.01); *F02D 29/02* (2013.01); *F02D 29/04* (2013.01)

(58) Field of Classification Search

None

See application file for complete search history.

(56) References Cited

U.S. PATENT DOCUMENTS 7,153,235 B2 * 12/2006 Takamura ..... B60W 10/04 477/170
8,676,457 B2 * 3/2014 Peterson ..... B60W 10/06 701/54
8,818,654 B2 * 8/2014 Koguchi ..... F02D 29/02 701/51
8,996,259 B2 * 3/2015 Kaneko ..... F02D 29/04 123/319
9,233,684 B2 * 1/2016 Park ..... F16H 61/061
2004/0185986 A1 * 9/2004 Takamura ..... B60W 10/04 477/170
2013/0089399 A1 * 4/2013 Kaneko ..... F02D 29/04 414/642
2013/0190996 A1 * 7/2013 Peterson ..... B60W 10/06 701/54
2013/0261906 A1 * 10/2013 Koguchi ..... F02D 29/02 701/51
2014/0067174 A1 * 3/2014 Park ..... F16H 61/061 701/22

FOREIGN PATENT DOCUMENTS

| | | | |
|---|---|---|---|
| EP | 2644873 | A2 | 10/2013 |
| GB | 2385844 | A | 9/2003 |
| JP | 2008-105532 | A | 5/2008 |
| JP | 2012-056763 | A | 3/2012 |

OTHER PUBLICATIONS

Communication dated Jul. 24, 2015, issued by the European Patent Office in counterpart Application No. 15160019.4.

* cited by examiner

*Primary Examiner* — Yonel Beaulieu
*Assistant Examiner* — Krishnan Ramesh
(74) *Attorney, Agent, or Firm* — Sughrue Mion, PLLC

(57) ABSTRACT

A power control device for a cargo handling vehicle provided with a cargo handling apparatus operated by a hydraulic oil from a hydraulic pump driven by an engine includes a controller and an engine speed sensor detecting an engine speed. The controller controls an engine torque to be limited by using an engine torque limit value for limiting the engine torque, and controls the engine torque limit on the engine by an engine torque limiting unit to be canceled when the engine speed detected by the engine speed sensor is equal to or lower than a predetermined first engine speed.

5 Claims, 5 Drawing Sheets

POWER CONTROL DEVICE FOR CARGO HANDLING VEHICLE

BACKGROUND OF THE INVENTION

Field of the Invention

The invention relates to a power control device for a cargo handling vehicle.

Related Background Art

As described in, for example, Japanese Unexamined Patent Application Publication No. 2012-56763, a power control device for a cargo handling vehicle that produces a control command for obtaining an engine speed corresponding to a depression operation amount of an accelerator pedal and controls an engine output torque in accordance with the control command is known as a power control device for a cargo handling vehicle according to the related art. Realization of fuel saving is strongly desired for the power control device for a cargo handling vehicle described above. Regarding hybrid cars, a technique for improving fuel economy by switching from a normal demand torque to a demand torque for fuel saving when an eco-mode switch is pressed is known as described in, for example, Japanese Unexamined Patent Application Publication No. 2008-105532.

SUMMARY OF THE INVENTION

In the hybrid car described in Japanese Unexamined Patent Application Publication No. 2008-105532, an engine output is supplemented by a motor output in an eco-mode so that the fuel economy is improved while the demand torque as a vehicle performance is being maintained. In the engine-type cargo handling vehicle described in Japanese Unexamined Patent Application Publication No. 2012-56763, on which no motor is mounted, the engine torque is limited in the eco-mode so that the fuel economy is improved. However, when the engine torque is highly limited for fuel economy improvement, a rapid cargo handling load fluctuation occurs when a heavy cargo is loaded on a cargo handling apparatus mounted on the cargo handling vehicle in an engine idling state, and the engine output may be abnormally dropped and engine stalling may occur, which is a problem specific to the cargo handling vehicle.

An object of the invention is to provide a power control device for a cargo handling vehicle that is capable of improving fuel economy while preventing engine stalling attributable to a cargo handling load.

A power control device according to a first aspect of the invention is a power control device for a cargo handling vehicle provided with a cargo handling apparatus operated by a hydraulic oil from a hydraulic pump driven by an engine, the power control device including engine torque limiting means for controlling an engine torque to be limited by using an engine torque limit value, engine speed detection means for detecting an engine speed, and engine torque limit cancelling means for controlling the torque limit on the engine by the engine torque limiting means to be canceled when the engine speed detected by the engine speed detection means is equal to or lower than a predetermined first engine speed.

In the power control device according to the first aspect of the invention, the engine torque limiting means controls the engine torque to be limited by using the engine torque limit value, and thus a contribution to fuel consumption reduction can be made. The engine speed detection means detects the engine speed, and the engine torque limit cancelling means controls the torque limit on the engine to be canceled when the engine speed is equal to or lower than the predetermined first engine speed. The first engine speed is, for example, an engine speed at which engine stalling is likely to occur in a state where the engine torque is limited. When the engine speed is the first engine speed, a rapid cargo handling load fluctuation in an engine idling state may, for example, cause the engine speed to drop and the engine stalling to occur. In the power control device according to the first aspect of the invention, the engine is controlled in a state where the torque limit on the engine is canceled by the engine torque limit cancelling means when the engine speed is equal to or lower than the first engine speed, and thus the engine stalling in the above-described case is prevented. In this manner, fuel economy of the cargo handling vehicle can be improved while the engine stalling attributable to a cargo handling load is prevented.

In the power control device according to the first aspect of the invention, the engine torque limiting means may set the engine torque limit value to a predetermined value when the engine speed detected by the engine speed detection means is equal to or higher than a second engine speed higher than the first engine speed.

In this configuration, the engine torque limiting means determines whether or not the engine speed is equal to or higher than the second engine speed higher than the first engine speed. The second engine speed is, for example, an engine speed at which the engine stalling is unlikely to occur in a state where the engine torque is limited. When the engine speed is equal to or higher than the second engine speed and the engine stalling is unlikely to occur, engine torque control means sets the engine torque limit value to, for example, a predetermined value and not being 100%. Accordingly, the engine torque can be limited and fuel consumption is sufficiently reduced.

In this case, the engine torque limiting means may have means for storing an engine torque limit value map in which the engine torque limit value is associated with the engine speed and may set the engine torque limit value to a value corresponding to the engine speed by using the engine torque limit value map when the engine speed detected by the engine speed detection means is higher than the first engine speed and is lower than the second engine speed.

In this configuration, the engine torque limiting means sets the engine torque limit value to the value corresponding to the engine speed by using the engine torque limit value map in which the engine torque limit value is associated with the engine speed when the engine speed is higher than the first engine speed and is lower than the second engine speed. Accordingly, in a case where the engine torque limit value has, for example, characteristics of continuous change following the engine speed, a rapid engine torque fluctuation can be suppressed since the engine torque limit value is set to the value corresponding to the engine speed.

The second engine speed may be lower than an idling engine speed. In the engine idling state, the engine torque may be limited for fuel consumption reduction. In this case, even a slight cancel of the torque limit on the engine in the engine idling state is prevented since the second engine speed is lower than the idling engine speed.

The power control device according to the first aspect of the invention may further include an accelerator opening sensor detecting an accelerator opening, and the engine torque limiting means may calculate a deviation between a target engine speed corresponding to the accelerator opening detected by the accelerator opening sensor and the engine speed detected by the engine speed detection means, may calculate an engine torque command value based on the calculated deviation, may adjust the calculated engine torque command value with the engine torque limit value, and may output the adjusted engine torque command value to the engine as a command signal so that the engine torque is controlled to be limited.

A power control device according to a second aspect of the invention is a power control device for a cargo handling vehicle provided with a cargo handling apparatus operated by a hydraulic oil from a hydraulic pump driven by an engine, the power control device including an engine speed sensor detecting an engine speed and a controller configured to limit an engine torque by using an engine torque limit value and cancel a torque limit on the engine when the engine speed detected by the engine speed sensor is equal to or lower than a predetermined first engine speed.

DESCRIPTION OF THE PREFERRED EMBODIMENTS

Figure 1:
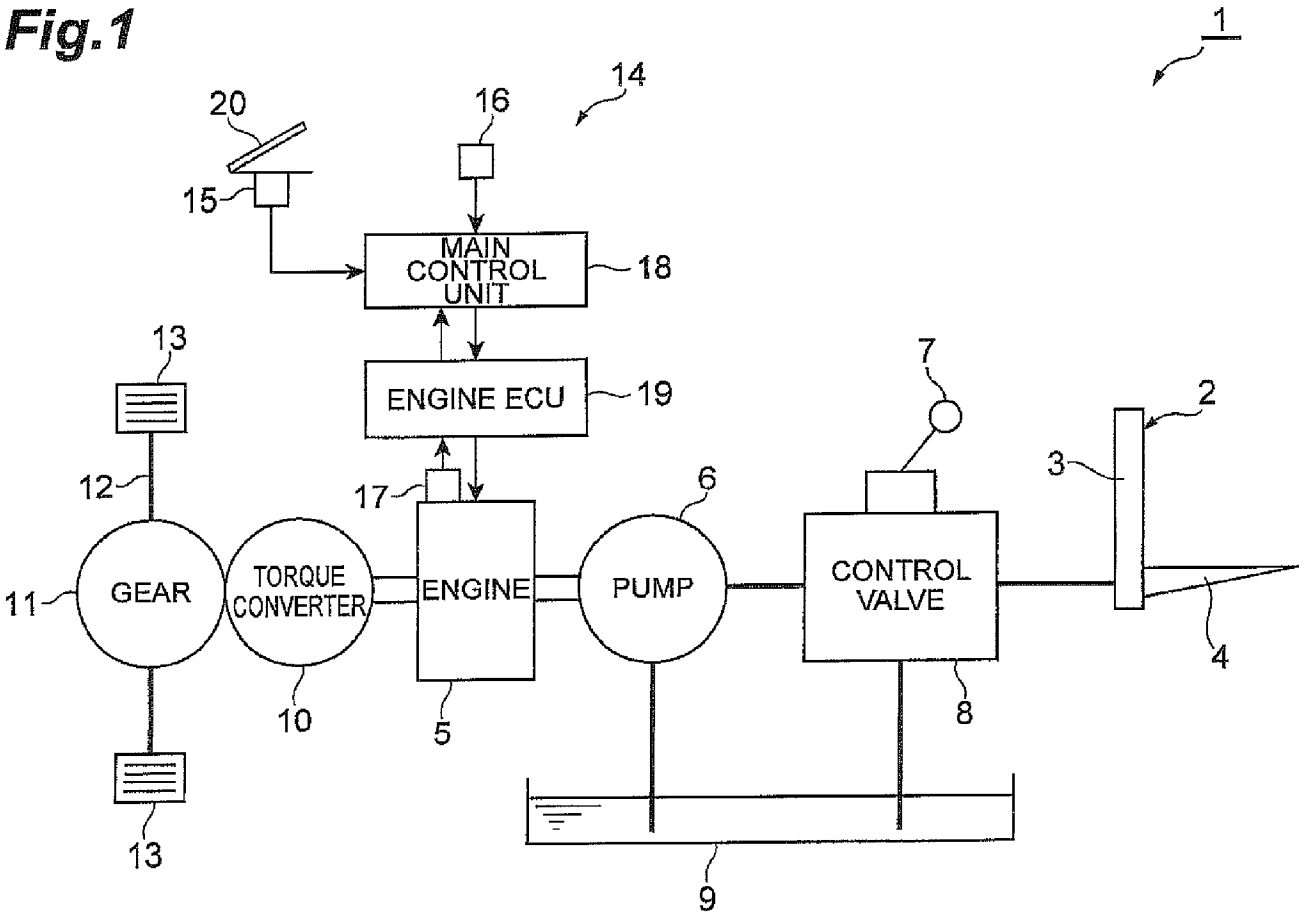
FIG. 1 is a configuration diagram illustrating a power control device for an engine-type forklift, which is an embodiment of a power control device for a cargo handling vehicle according to the invention, along with a schematic configuration of the forklift.

Hereinafter, an embodiment of the invention will be described in detail with reference to accompanying drawings. In the following description, the same reference numerals will be used to refer to the same elements or elements having the same functions and duplicate description will be omitted.

FIG. 1 is a configuration diagram illustrating a power control device for an engine-type forklift, which is the embodiment of a power control device for a cargo handling vehicle according to the invention, along with a schematic configuration of the forklift.

In the drawing, a forklift 1 is provided with a cargo handling apparatus 2. The cargo handling apparatus 2 is provided with a mast 3, a fork 4, a lift cylinder (not illustrated), and a tilt cylinder (not illustrated). The fork 4 is mounted on the mast 3 via a lift bracket (not illustrated). A cargo is loaded on the fork 4. The lift cylinder lifts and lowers the fork 4. The tilt cylinder tilts the mast 3 forward or backward. The cargo handling apparatus 2 may be further provided with an attachment such as a roll clamp and a drum clamp.

In addition, the forklift 1 is provided with an engine 5, a hydraulic pump 6, and a control valve 8. The engine 5 functions as a driving source for a traveling operation and a cargo handling operation. The hydraulic pump 6 is driven by the engine 5. The control valve 8 is arranged between the hydraulic pump 6, and the lift cylinder and tilt cylinder of the cargo handling apparatus 2. The control valve 8 controls hydraulic oil supply from the hydraulic pump 6 to the lift cylinder and the tilt cylinder according to an operation amount of a cargo handling lever 7. Both a diesel engine and a gasoline engine may be used as the engine 5. Both an electromagnetic valve and a mechanical valve may be used as the control valve 8.

The cargo handling lever 7 is a lever for performing the cargo handling operation and includes a lift lever and a tilt lever. When a lift rising operation is performed by the lift lever, the hydraulic pump 6 pumps up a hydraulic oil from a tank 9, and the hydraulic oil is supplied to the lift cylinder via the control valve 8 so that the fork 4 is raised. When a lift lowering operation is performed by the lift lever, the hydraulic oil from the lift cylinder returns to the tank 9 via the control valve 8 due to weight of the fork 4 itself. When a forward tilting operation or a backward tilting operation is performed by the tilt lever, the hydraulic oil is pumped up from the tank 9 by the hydraulic pump 6, and the hydraulic oil is supplied to the tilt cylinder via the control valve 8 so that the mast 3 is tilted forward or backward.

An axle 12 is connected to the engine 5 via a torque converter 10 and a differential gear 11. Drive wheels 13 are mounted on both respective sides of the axle 12. An output of the engine 5 is transmitted to the drive wheels 13 via the torque converter 10, the differential gear 11, and the axle 12. A manual transmission may be disposed instead of the torque converter 10.

In addition, the forklift 1 is provided with a power control device 14 according to this embodiment. The power control device 14 is provided with an accelerator opening sensor 15, an eco-mode switch 16, an engine speed sensor 17, and a controller CONT. The controller CONT includes a main control unit 18 and an engine electronic control unit (ECU) 19.

The accelerator opening sensor 15 is a sensor that detects a depression amount (also referred to as an "accelerator opening") of an accelerator pedal 20. The eco-mode switch 16 is a switch for switching between a normal mode for a normal operation and an eco-mode for fuel-saving driving. The engine speed sensor 17 is a sensor that detects an actual engine speed of the engine 5. In other words, the engine speed sensor 17 functions as engine speed detection means. The engine speed sensor 17 detects the actual engine speed of the engine 5 by, for example, detecting a crank angle of the engine 5.

Figure 2:
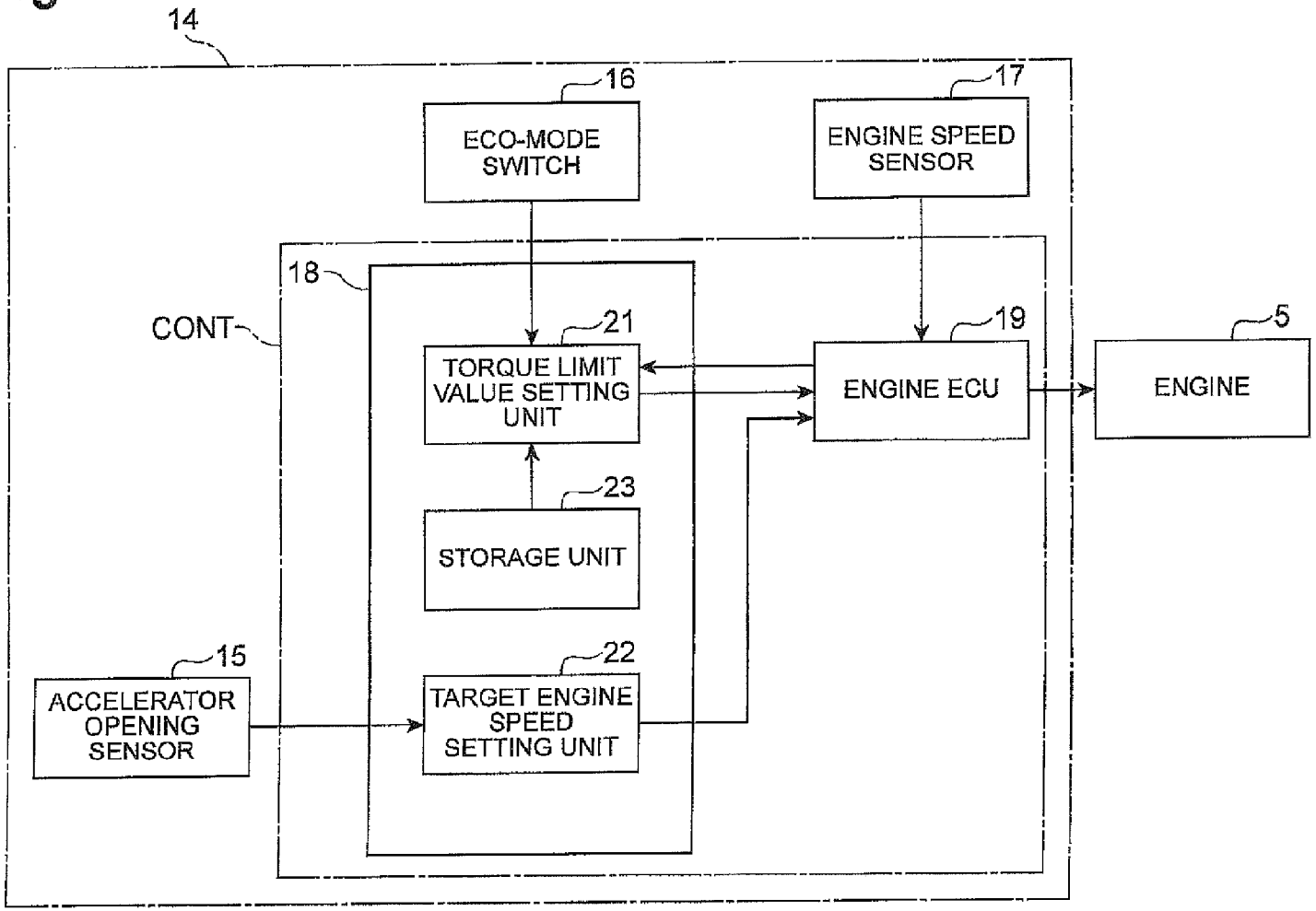
FIG. 2 is a block diagram illustrating a function of a main control unit illustrated in FIG. 1.

As illustrated in FIG. 2, the main control unit 18 has a torque limit value setting unit 21, a target engine speed setting unit 22, and a storage unit 23. The torque limit value setting unit 21 sets an engine torque limit value for limiting an engine torque of the engine 5 (hereinafter, also referred to as an "engine torque") based on an operation signal of the eco-mode switch 16 and a detection value of the engine speed sensor 17. The engine torque limit value is an upper limit value that is set for the engine torque not to be generated in excess of the value. The engine torque limit value being 100% means that the engine torque is not limited. A processing function of the torque limit value setting unit 21 will be described in detail later. The target engine speed setting unit 22 sets a target engine speed of the engine 5 (hereinafter, also referred to as a "target engine speed") corresponding to the accelerator opening detected by the accelerator opening sensor 15.

Each of the main control unit 18 and the ECU 19 is provided with a central processing unit (CPU), a read only memory (ROM), a random access memory (RAM), and the like. Each of the main control unit 18 and the ECU 19 performs various controls by loading a program stored in the ROM, onto the RAM and executing the program in the CPU.

Figure 3:
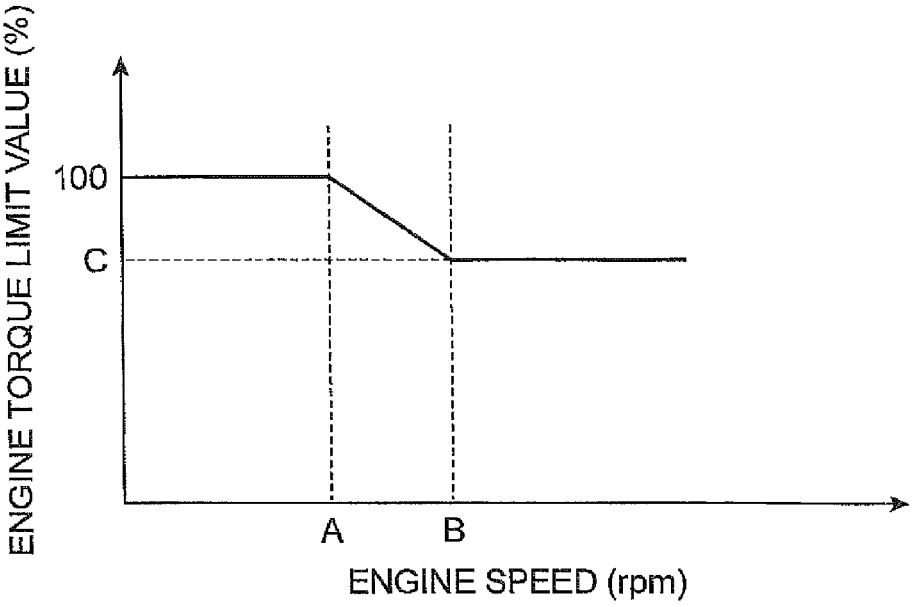
FIG. 3 is a graph illustrating an engine torque limit value map stored in a storage unit illustrated in FIG. 2.

The storage unit 23 stores an engine torque limit value map illustrated in FIG. 3 as data used for engine torque limit value setting processing by the torque limit value setting unit 21. The engine torque limit value map is stored in the ROM. The engine torque limit value map is a map in which the engine torque limit value is associated with the engine speed of the engine 5 (hereinafter, also referred to as an "engine speed"). In other words, the engine torque limit value map is a map that shows a relationship between the engine speed and the engine torque limit value.

In the engine torque limit value map, the engine torque limit value is set to 100% when the engine speed is equal to or lower than a low-side engine speed threshold A that is a first engine speed and the engine torque limit value is set to C % when the engine speed is equal to or higher than a high-side engine speed threshold B that is a second engine speed. C % is a predetermined value that is lower than 100%. In addition, in the engine torque limit value map, the engine torque limit value is set to decrease linearly from 100% to C % within a range of the low-side engine speed threshold A to the high-side engine speed threshold B.

The low-side engine speed threshold A is, for example, an engine speed at which engine stalling is likely to occur in a state where the engine torque is limited. The high-side engine speed threshold B is, for example, an engine speed at which the engine stalling is unlikely to occur in a state where the engine torque is limited. The high-side engine speed threshold B is higher than the low-side engine speed threshold A and is lower than an idling engine speed of the engine 5 (that is, low-side engine speed threshold A<high-side engine speed threshold B<idling engine speed). A predetermined value C is a value at which the engine torque is limited so that fuel consumption reduction is possible. The engine speed thresholds A and B and the predetermined value C vary depending on the type of the engine or the like and optimum values are determined in advance in an experiment or the like.

Figure 4:
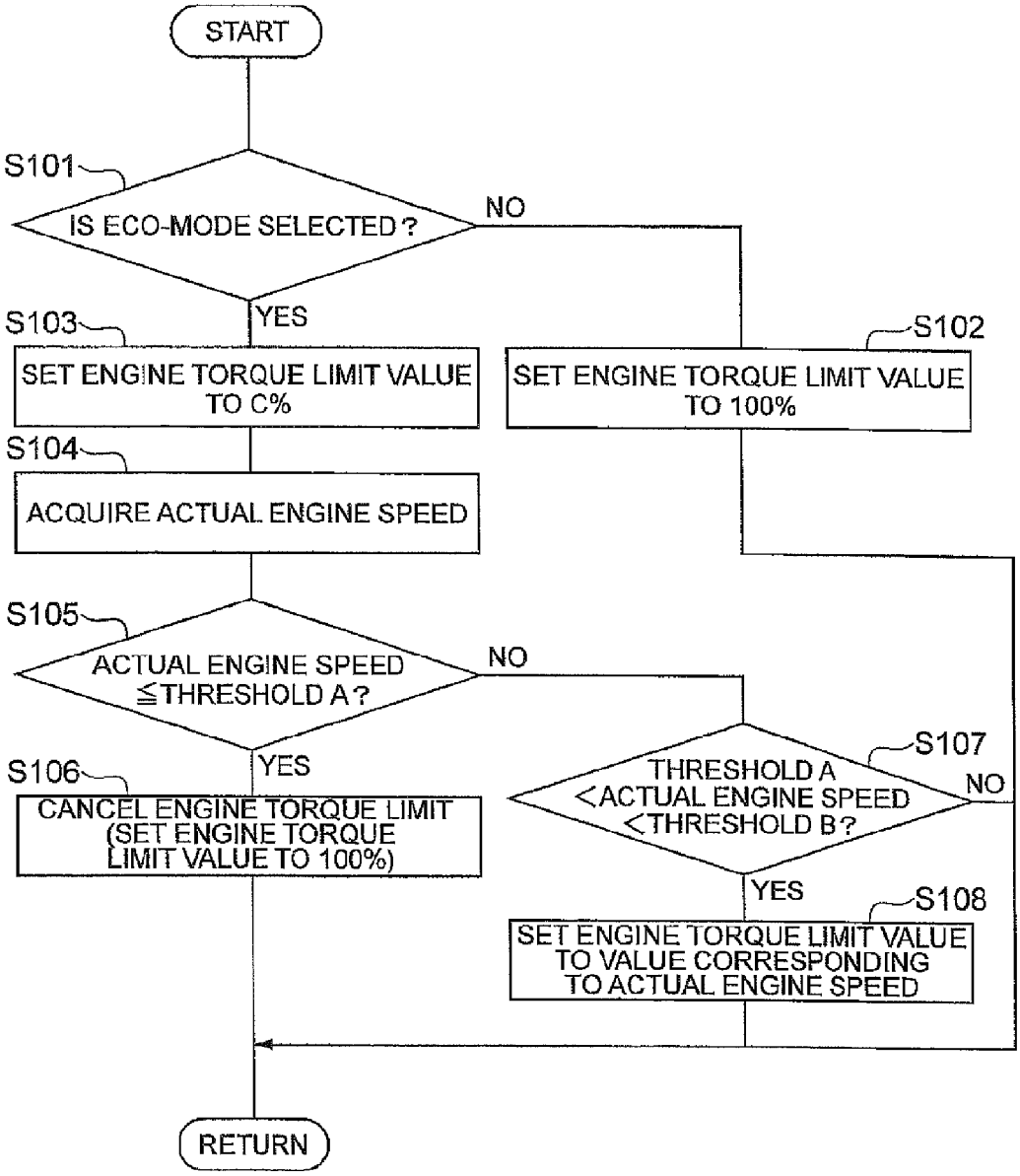
FIG. 4 is a flowchart illustrating details of an engine torque limit value setting processing step by a torque limit value setting unit illustrated in FIG. 2.

FIG. 4 is a flowchart illustrating details of an engine torque limit value setting processing step by the torque limit value setting unit 21. In the drawing, the torque limit value setting unit 21 first determines whether or not the eco-mode is selected by the eco-mode switch 16 (Step S101).

When not the eco-mode but the normal mode is selected by the eco-mode switch 16, the torque limit value setting unit 21 sets the engine torque limit value to 100% (Step S102). In other words, the engine torque of the engine 5 is not limited when the normal mode is selected.

When the eco-mode is selected by the eco-mode switch 16, the torque limit value setting unit 21 sets the engine torque limit value to C % (Step S103). Then, the torque limit value setting unit 21 acquires the actual engine speed detected by the engine speed sensor 17 via the engine ECU 19 (Step S104).

Then, the torque limit value setting unit 21 determines whether or not the actual engine speed is equal to or lower than the low-side engine speed threshold A (Step S105). When the actual engine speed is equal to or lower than the low-side engine speed threshold A, the torque limit value setting unit 21 changes the setting of the engine torque limit value to 100% based on the engine torque limit value map (refer to FIG. 3) stored in the storage unit 23 (Step S106). In other words, the torque limit value setting unit 21 cancels the torque limit on the engine 5.

When the actual engine speed is determined to exceed the low-side engine speed threshold A in Step S105, the torque limit value setting unit 21 determines whether or not the actual engine speed is higher than the low-side engine speed threshold A and is lower than the high-side engine speed threshold B (Step S107). When the actual engine speed is higher than the low-side engine speed threshold A and is lower than the high-side engine speed threshold B, the torque limit value setting unit 21 changes the setting of the engine torque limit value to a value corresponding to the actual engine speed based on the engine torque limit value map (refer to FIG. 3) stored in the storage unit 23 (Step S108).

When the actual engine speed is determined not to be in a state of being higher than the low-side engine speed threshold A and being lower than the high-side engine speed threshold B in Step S107, that is, when the actual engine speed is determined to be equal to or higher than the high-side engine speed threshold B in Step S107, the torque limit value setting unit 21 maintains the engine torque limit value at C %.

Referring back to FIG. 2, the engine ECU 19 sends the actual engine speed detected by the engine speed sensor 17 to the torque limit value setting unit 21. In addition, the engine ECU 19 controls the engine so as to limit the engine torque (also referred to as "power") based on the actual engine speed detected by the engine speed sensor 17, the target engine speed set by the target engine speed setting unit 22, and the engine torque limit value set by the torque limit value setting unit 21. In other words, combustion of the engine is controlled and the engine torque is limited.

Specifically, the engine ECU 19 calculates a deviation between the target engine speed and the actual engine speed, obtains an engine torque command value at which the deviation is zero, adjusts the engine torque command value with the engine torque limit value, and sends the adjusted engine torque command value to the engine 5 as a command signal.

In a case where, for example, the normal mode is selected by the eco-mode switch 16, the engine torque limit value is 100% and thus the engine torque command value is sent as it is to the engine 5 as the command signal. When the engine torque limit value is, for example, C % in a case where the eco-mode is selected by the eco-mode switch 16, the C % of the engine torque command value is sent to the engine 5 as the command signal.

In a case where the engine 5 is the diesel engine, the command signal is sent to a fuel injection valve. In this case, the amount of fuel injection by the fuel injection valve is limited in the eco-mode. As a result, the engine torque is limited. In a case where the engine 5 is the gasoline engine, the command signal is sent to a throttle valve. In this case, the opening of the throttle valve, that is, the amount of air intake to the engine 5, is limited in the eco-mode. As a result, the engine torque is limited.

The torque limit value setting unit 21 of the main control unit 18, the storage unit 23 of the main control unit 18, and the engine ECU 19 described above constitute engine torque limiting means for controlling the engine torque of the engine 5 to be limited by using the engine torque limit value and engine torque limit cancelling means for controlling the torque limit on the engine 5 by the engine torque limiting means to be canceled when the engine speed detected by the engine speed detection means 17 is equal to or lower than the predetermined first engine speed A.

In this case, the above-described steps S103, S104, S107, and S108 of the torque limit value setting unit 21 function as parts of the engine torque limiting means. The above-described steps S104 to S106 of the torque limit value setting unit 21 function as parts of the engine torque limit cancelling means.

Figure 5:
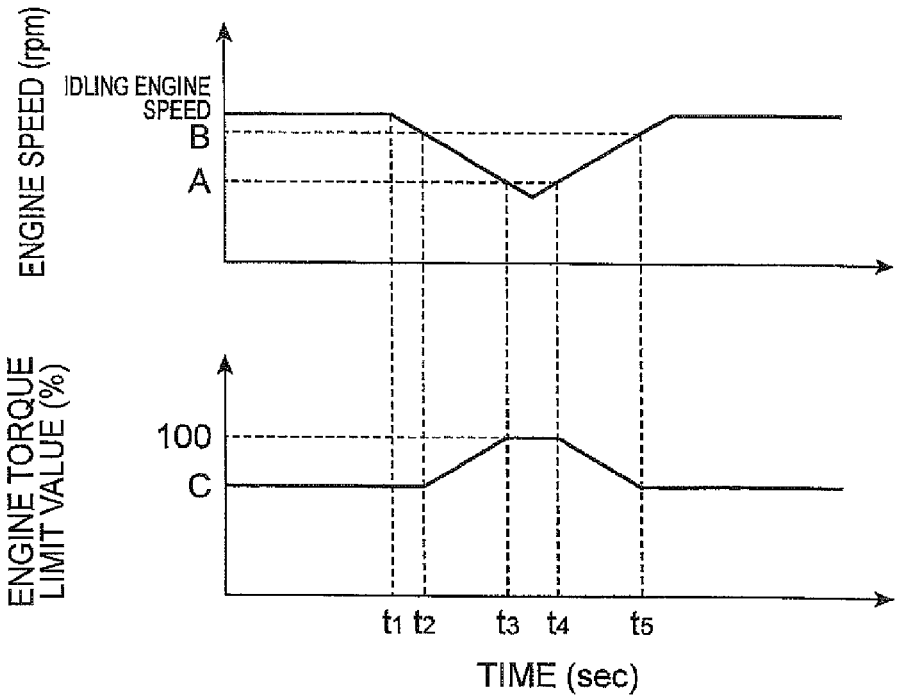
FIG. 5 is a time chart illustrating an example of a relationship between an engine speed and an engine torque limit value.

Next, an operation of the power control device 14 according to this embodiment will be described with reference to FIG. 5. Referring to FIG. 5, the engine torque limit value is C % when the engine speed is the idling engine speed. In other words, the engine 5 is in a torque-limited state when the engine speed is the idling engine speed. Accordingly, a fuel consumption reduction effect can be maintained.

When a heavy cargo is loaded on the cargo handling apparatus 2 at time t1, the engine speed starts to drop from the idling engine speed. When the engine speed reaches the high-side engine speed threshold B at time t2, the engine torque limit value starts to increase from C %. In this case, the engine torque limit value linearly increases as a result of the drop in the engine speed, and thus rapid engine torque fluctuation is suppressed.

When the engine speed decreases to the low-side engine speed threshold A at time t3, the engine torque limit value becomes 100%. In other words, the engine 5 is in a torque limit-canceled state. Then, the engine torque limit value remains at 100% even if the engine speed further decreases. Since the torque limit on the engine 5 is canceled, the engine 5 generates a sufficient torque against the drop in the engine speed by a cargo handling load during an idling state of the engine 5, and can avoid the engine stalling.

When the torque limit on the engine 5 is canceled, the engine speed starts to increase. When the engine speed reaches the low-side engine speed threshold A at time t4, the engine torque limit value starts to decrease from 100%. In this case, the engine torque limit value linearly drops as a result of the rise in the engine speed, and thus a rapid engine torque fluctuation is suppressed.

When the engine speed reaches the high-side engine speed threshold B at time t5, the engine torque limit value becomes C %. Then, the engine torque limit value is maintained at C % even if the engine speed further increases. Accordingly, the fuel consumption reduction effect can be maintained.

According to this embodiment described above, the engine torque limit value is 100% and the torque limit on the engine 5 is canceled, even in a case where the eco-mode is selected, when the engine speed is equal to or lower than the low-side engine speed threshold A. Accordingly, the engine stalling can be prevented even when the heavy cargo is loaded on the cargo handling apparatus 2 in the idling state of the engine 5 and the engine speed becomes lower than the idling engine speed due to a rapid cargo handling load fluctuation. In addition, the engine torque limit value becomes C % and the engine torque of the engine 5 is limited when the engine speed is equal to or higher than the high-side engine speed threshold B. Accordingly, a contribution to fuel consumption reduction can be made. Accordingly, the engine stalling attributable to the rapid cargo handling load fluctuation can be prevented and the forklift 1 can have improved fuel economy.

When the engine speed is higher than the low-side engine speed threshold A and is lower than the high-side engine speed threshold B, the engine torque limit value changes linearly and gradually as a result of a change in the engine speed. Accordingly, the rapid engine torque fluctuation can be suppressed, and a driver can be prevented from feeling discomfort.

Since the high-side engine speed threshold B is lower than the idling engine speed, an increase in the engine torque limit value due to an engine speed fluctuation is prevented in the idling state of the engine 5. Accordingly, even a slight cancel of the torque limit on the engine 5 is prevented in the idling state of the engine 5. Accordingly, the fuel economy can be further improved.

The invention is not limited to the embodiment described above. For example, the engine torque limit value may be changed non-linearly according to the engine speed insofar as the engine torque limit value is changed continuously and gradually although the engine torque limit value is changed linearly according to the engine speed within the range in which the engine speed is higher than the low-side engine speed threshold A and is lower than the high-side engine speed threshold B in the embodiment described above.

The high-side engine speed threshold B is lower than the idling engine speed in the embodiment described above. However, the high-side engine speed threshold B may be equal to the idling engine speed in a case where the engine speed fluctuation is slight in the idling state of the engine 5.

The engine torque of the engine-type forklift is controlled in the embodiment described above. However, the power control device of the invention can be applied to an engine-type cargo handling vehicle provided with a cargo handling apparatus such as a bucket as well as the forklift.

What is claimed is:

1. A power control device for a cargo handling vehicle provided with a cargo handling apparatus operated by a hydraulic oil from a hydraulic pump driven by an engine, the power control device comprising:

engine torque limiting means for controlling an engine torque to be limited by using an engine torque limit value;

engine speed detection means for detecting an engine speed; and engine torque limit cancelling means for controlling a torque limit on the engine by the engine torque limiting means to be canceled when the engine speed detected by the engine speed detection means is equal to or lower than a predetermined first engine speed, wherein the engine torque limiting means sets the engine torque limit value to a predetermined value when the engine speed detected by the engine speed detection means is equal to or higher than a second engine speed higher than the first engine speed.

2. The power control device for a cargo handling vehicle according to claim 1, wherein the engine torque limiting means includes means for storing an engine torque limit value map in which the engine torque limit value is associated with the engine speed and sets the engine torque limit value to a value corresponding to the engine speed by using the engine torque limit value map when the engine speed detected by the engine speed detection means is higher than the first engine speed and is lower than the second engine speed.

3. The power control device for a cargo handling vehicle according to claim 1, wherein the second engine speed is lower than an idling engine speed of the engine.

4. The power control device for a cargo handling vehicle according to claim 1, further comprising:

an accelerator opening sensor detecting an accelerator opening, wherein the engine torque limiting means calculates a deviation between a target engine speed corresponding to the accelerator opening detected by the accelerator opening sensor and the engine speed detected by the engine speed detection means, calculates an engine torque command value based on the calculated deviation, adjusts the calculated engine torque command value with the engine torque limit value, and outputs the adjusted engine torque command value to the engine as a command signal so that the engine torque is controlled to be limited.

5. A power control device for a cargo handling vehicle provided with a cargo handling apparatus operated by a hydraulic oil from a hydraulic pump driven by an engine, the power control device comprising:

an engine speed sensor detecting an engine speed; and a controller configured to limit an engine torque by using an engine torque limit value and cancel a torque limit on the engine when the engine speed detected by the engine speed sensor is equal to or lower than a predetermined first engine speed, and set the engine torque limit value to a predetermined value when the engine speed detected by the engine speed sensor is equal to or higher than a second engine speed higher than the first engine speed.

* * * * *